United States Patent [19]

Murata et al.

[11] Patent Number: 4,964,190

[45] Date of Patent: Oct. 23, 1990

[54] FLOOR NOZZLE OF A VACUUM CLEANER

[75] Inventors: Yoshitaka Murata, Shiga; Hiroshi Kawakami, Yokaichi, both of Japan

[73] Assignee: Matsushita Electric Industrial Co., Ltd., Osaka, Japan

[21] Appl. No.: 476,117

[22] Filed: Jan. 30, 1990

Related U.S. Application Data

[63] Continuation-in-part of Ser. No. 245,690, Sep. 15, 1988, abandoned.

[30] Foreign Application Priority Data

Sep. 16, 1987 [JP] Japan ..... 62-231315
Sep. 16, 1987 [JP] Japan ..... 62-141339[U]

[51] Int. Cl.[5] ..... A47L 9/04
[52] U.S. Cl. ..... 15/369; 15/364; 15/388
[58] Field of Search ..... 15/369, 373, 388, 398

[56] References Cited

U.S. PATENT DOCUMENTS

| | | | |
|---|---|---|---|
| 1,191,999 | 7/1916 | Roever | 15/369 |
| 1,228,176 | 5/1917 | Bishop | 15/369 |
| 2,325,739 | 8/1943 | Brock | 15/369 |
| 2,556,022 | 6/1951 | Atiyeh | 15/369 |
| 2,921,331 | 1/1960 | Stevens | 15/369 X |

FOREIGN PATENT DOCUMENTS

| | | | |
|---|---|---|---|
| 487951 | 12/1929 | Fed. Rep. of Germany | 19/369 |
| 51484 | 11/1941 | Netherlands | 15/369 |

*Primary Examiner*—Chris K. Moore
*Attorney, Agent, or Firm*—Wenderoth, Lind & Ponack

[57] ABSTRACT

A floor nozzle of a vacuum cleaner is provided with an upper nozzle housing hingedly connected to an intake joint of the cleaner and a lower nozzle housing securely connected to the upper nozzle housing through a bumper, with an intake opening being formed on a lower side of the lower nozzle housing. A first air passage communicating between the intake opening and the intake joint is formed in the upper and lower nozzle housings. A dust collector is accommodated in the nozzle housings, and defines in it a second air passage communicating the first air passage. A thread catcher is so accommodated in the dust collector as to be rotatable in response to forward and rearward movement of the floor nozzle. The thread catcher is capable of catching waste thread on a surface to be cleaned when it rotates upon forward movement of the floor nozzle. A scraper is accommodated in the dust collector for removing the waste thread caught by the thread catcher when the thread catcher rotates upon rearward movement of the floor nozzle. A covering member is hingedly connected to the dust collector for opening or closing the second air passage.

17 Claims, 5 Drawing Sheets

FLOOR NOZZLE OF A VACUUM CLEANER

This application is a continuation-in-part of now abandoned application, Ser. No. 07/245,690 filed on Sept. 15, 1988, and now abandoned.

BACKGROUND OF THE INVENTION

1. Field of the Invention

The present invention generally relates to a vacuum cleaner for ordinary household use, and more particularly, to a floor nozzle of the vacuum cleaner.

2. Description of the Prior Art

Japanese Patent Publication No. 59-52548 discloses a floor nozzle of a vacuum cleaner for raking up dust or waste thread on a carpet, a hard floor made of wood or the like, drawing the dust into a dust bag accommodated in a cleaner body.

Japanese Patent Publication No. 52-6036 discloses another floor nozzle for a vacuum cleaner.

These prior art nozzles are shown in FIGS. 1 and 2.

The floor nozzle shown in FIG. 1 is provided with an intake opening 2 formed on a lower side of a nozzle body 1 and a plurality of brushes 3 disposed in front of and behind the intake opening 2 for raking up dust on a floor. The brushes 3 are so held by respective holders 4 as to be adjustable in their vertical positions according to the kind of surface to be cleaned. The nozzle body 1 is supported by a pair of rollers 6 and communicates a suction side of the cleaner body by way of an intake joint 5.

FIG. 2 depicts an attachment nozzle provided with a cylindrical rotor 8 inside and at a central portion of a nozzle body 7 and a pair of guide walls 9 each having a circular internal surface 9*a* spaced from the rotor 6 at a fixed interval. A great number of inclined short bristles 10 are formed on the entire external surface of the rotor 8 and on the entire internal surfaces of the paired guide walls 9*a* to rake up dust on a surface to be cleaned. Arrows shown in FIG. 2 indicate intake air flows.

When the vacuum cleaner having the conventional floor nozzle of FIG. 1 is used on a carpet, the brushes 3 are caused to move inwards so as not to be caught by the carpet and not to prevent the cleaner from smoothly moving on the carpet. Because of this, the suction force of the cleaner, even with the slight raking by the brushes 3, can not sufficiently catch fibrous dust, for example, waste thread on the carpet, and therefore, the dust is frequently left on the carpet. Consequently, the vacuum cleaner of this kind can not fully use its ability, and can not keep itself clean, since the waste thread caught by the brushes 3 can not be drawn into the cleaner and is kept caught on the brushes 3.

In the example of FIG. 2, the bristles 10 of the rotor 8 are occasionally caught by the carpet according to the kind of the carpet or due to an unevenness of force imparted by an operator. This imposes an extremely increased force upon the operator in order to operate the nozzle. Accordingly, the operator sometimes feels it hard to control the vacuum cleaner with this attachment nozzle. This attachment nozzle is not serviceable in cleaning the hard floor, since the rotor 8 with the bristles 10 has the disadvantage of poor handling on the hard floor, or hard particles such as sand or the like caught by the bristles 10 sometimes scratch the surface of the floor.

SUMMARY OF THE INVENTION

Accordingly, the present invention has been developed with a view toward substantially eliminating the above described disadvantages inherent in the prior art floor nozzles for a vacuum cleaners, and has as an essential object the provision of an improved floor nozzle capable of readily catching and drawing therein waste thread or the like irrespective of the surface to be cleaned.

Another important object of the present invention is to provide a floor nozzle capable of positively drawing therein relatively heavy particles, such as sand or the like, on a hard floor.

A further object of the present invention is to provide a floor nozzle which is easy to handle.

A still further object of the present invention is to provide a floor nozzle which is simplified in its maintenance.

In accomplishing these and other objects, the floor nozzle according to one preferred embodiment of the present invention is provided with an upper nozzle housing hingedly connected to an intake joint of the cleaner, a lower nozzle housing securely connected to the upper nozzle housing and defining an intake opening on its lower side, and a dust collector accommodated in the upper and lower nozzle housings.

A first air passage communicating between the intake opening and the intake joint is formed in the upper and lower nozzle housings and with communicates a second air passage formed in the dust collector. A thread catcher and a scraper are accommodated in the dust collector. The thread catcher is rotatable in response to forward and rearward movement of the floor nozzle, and is capable of removing waste thread from a floor surface to be cleaned when the thread catcher rotates upon forward movement of the floor nozzle. The scraper is capable of removing the waste thread caught by the thread catcher when the thread catcher rotates upon rearward movement of the floor nozzle. A covering member is hingedly connected to the dust collector for opening or closing the second air passage in response to a manual lever provided on the floor nozzle.

The thread catcher is provided with a great number of bristles on its circular surface located at a rear portion of the floor nozzle. When an operator pushes the cleaner, the thread catcher rotates so as to be accommodated in the dust collector. In this event, the bristles of the thread catcher are never brought into contact with the surface to be cleaned. In other words, when the cleaner is pushed forward the bristles of the thread catcher with increased frictional resistance between them and the surface to be cleaned, are retracted inside the floor nozzle. This fact results in a lowered operational force and causes the cleaner to be easy to handle.

Furthermore, to simplify nozzle maintenance, the thread catcher is detachably mounted in the dust collector. This is especially advantageous when the bristles of the thread catcher have almost worn out due to long-term use of the floor nozzle or when the thread catcher will not rotate due to clogging by relatively large dust, such as cotton dust or the like.

BRIEF DESCRIPTION OF THE DRAWINGS

The above and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 1:
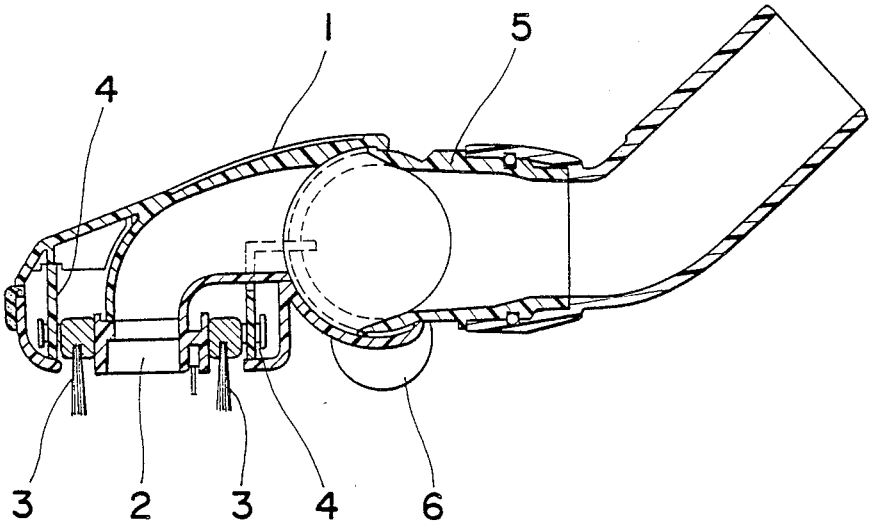
Fig. 1 PRIOR ART
FIG. 1 is a longitudinal sectional view of a conventional floor nozzle.
Figure 2:
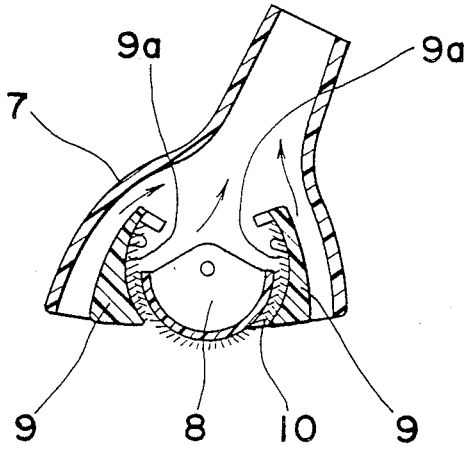
Fig. 2 PRIOR ART
FIG. 2 is a view similar to FIG. 1, of another conventional floor nozzle.
Figure 3:
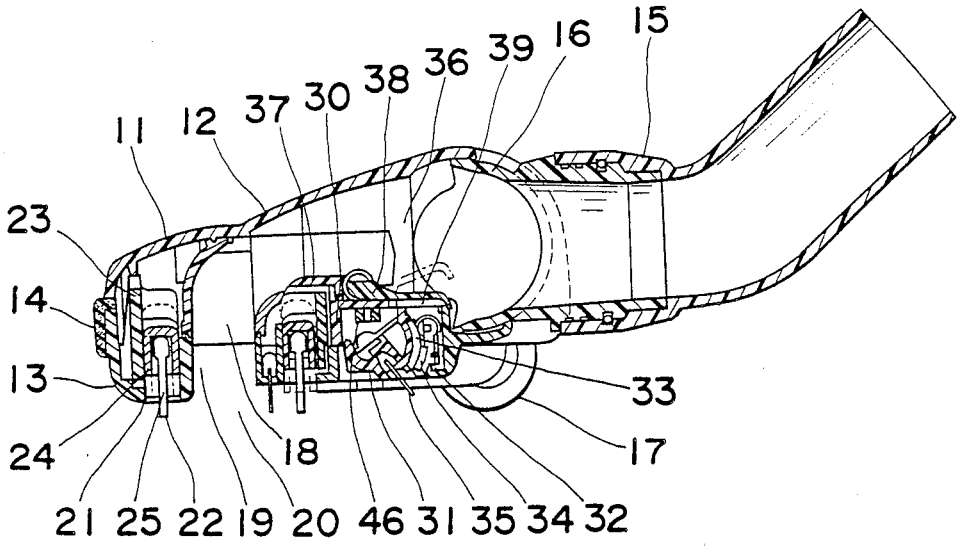
FIG. 3 is a longitudinal sectional view of a floor nozzle according to one preferred embodiment of the present invention.
Figure 4:
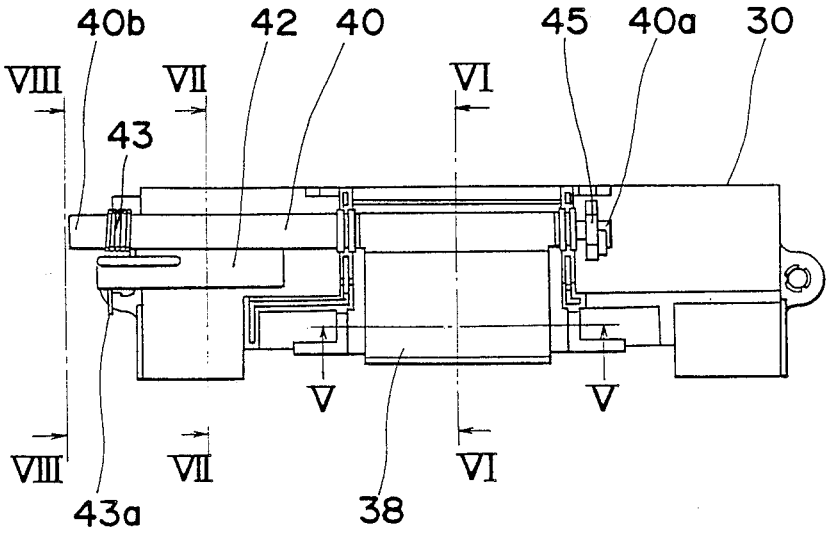
FIG. 4 is a top plan view of a dust collector provided in the floor nozzle of FIG. 3.
Figure 5:
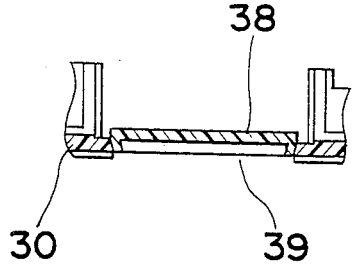
FIG. 5 is a section taken along the line V—V of FIG. 4.
Figure 6:
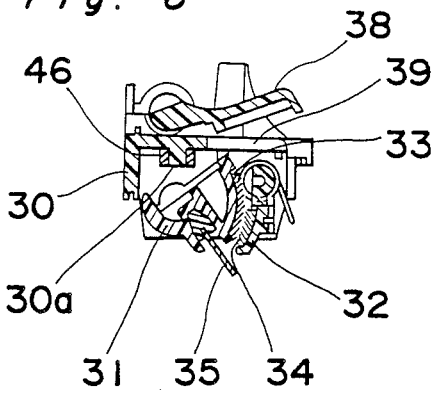
FIG. 6 is a section taken along the line VI—VI of FIG. 4.

FIGS. 3 to 11 depict a floor nozzle according to one preferred embodiment of the present invention. A nozzle body 11 of the floor nozzle is primarily comprised of an upper nozzle housing 12 and a lower nozzle housing 13, both of which are securely connected through a bumper 14. A rear central portion of the nozzle body 11 is formed circularly to be hingedly connected with a substantially cylindrical portion of an intake joint 15. A pair of rollers 17 are disposed below and on respective sides of the intake joint 15, thereby rendering the floor nozzle to be readily movable. The lower nozzle housing 13 of the nozzle body 11 is provided with a dust intake portion 20 and a pair of slits 21, one formed in front of and one behind the dust intake portion 20, and parallel therewith. The dust intake portion 20 has an intake opening 18 at its central portion and two grooves 19 extending outwards from the intake opening 18 and having open outer ends.

Figure 9:
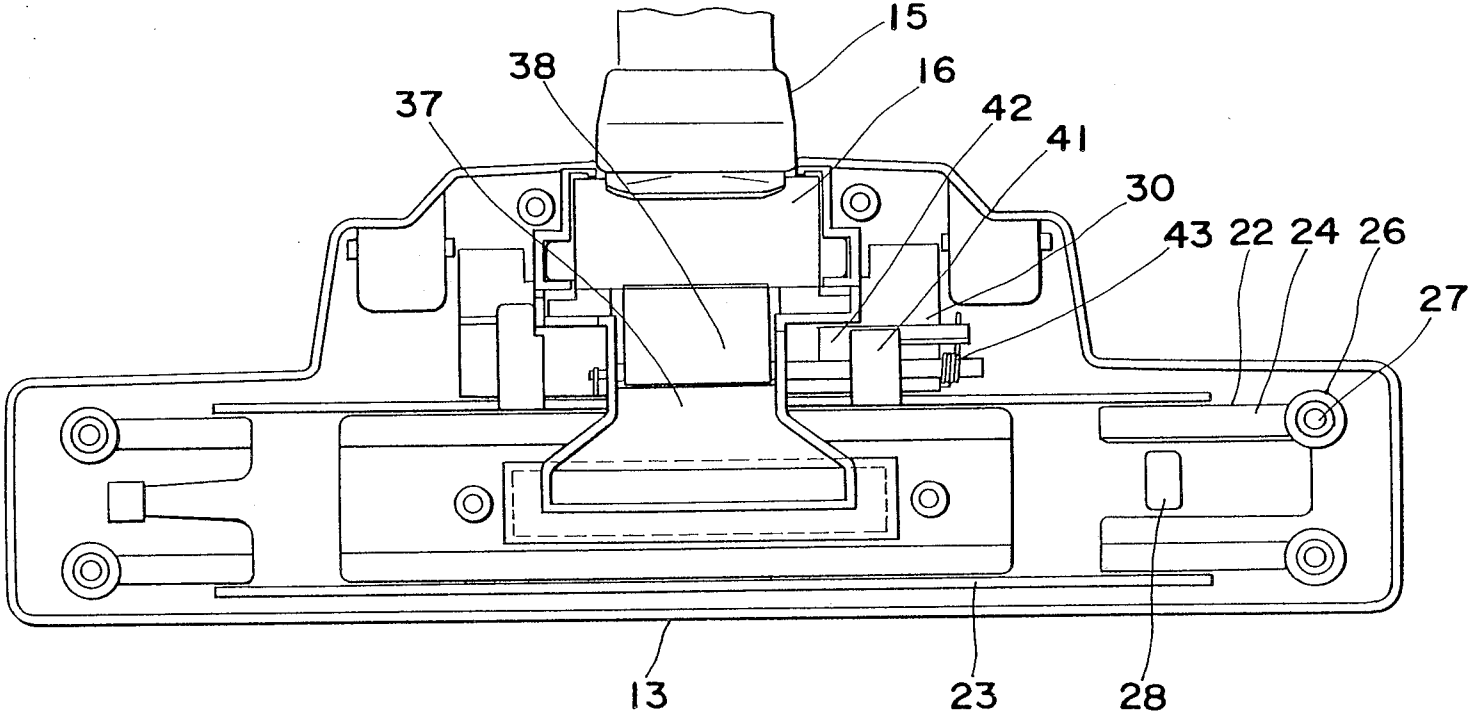
FIG. 9 is a top plan view of the floor nozzle with an upper nozzle housing being removed.

The nozzle body 11 accommodates a pair of brushes 22 and brush regulators 23 adjacent the respective brushes 22 for moving the brushes up and down. Each of the brushes 22 is of the construction in which a bundle of bristles 25 is securely held by a brush holder 24 and is free to move up and down, since a plurality of bosses 27 protruding from the upper nozzle housing 12 are loosely inserted into respective guide openings 26 formed at opposite ends of the brush holders 24, as shown in FIG. 9. Upon vertical movement, the brushes 22 can protrude downwards from the nozzle body 11 through the slits 21 or can retract inside it.

Figure 10:
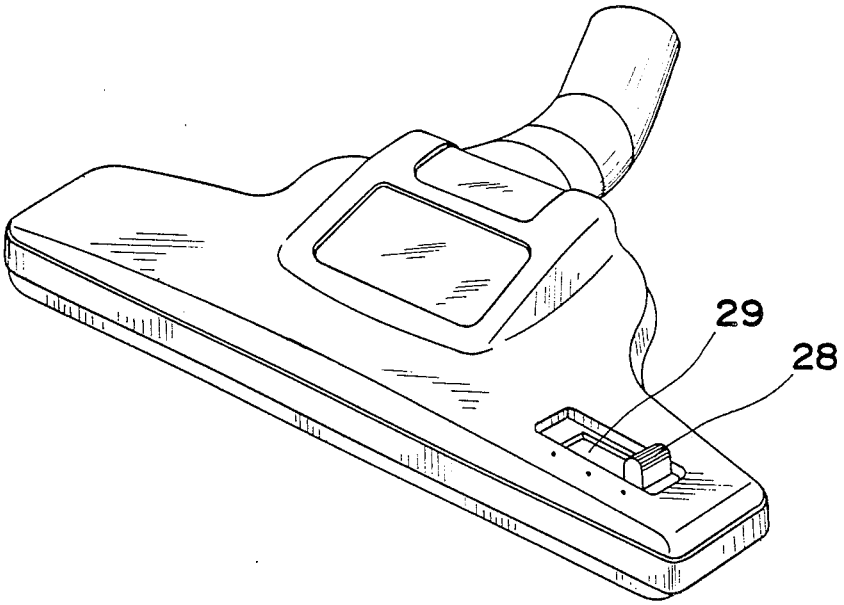
FIG. 10 is a perspective view of the floor nozzle of FIG. 3.
Figure 11:
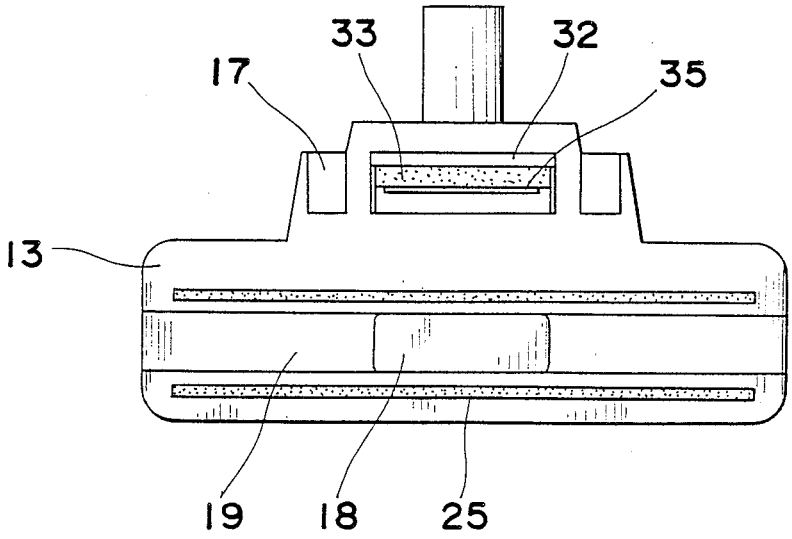
FIG. 11 is a bottom plan view of the floor nozzle of FIG. 3.

As shown in FIG. 10, the brush regulators 23 can be controlled by a lever 28 protruding outwards from a through-opening 29 formed in the upper nozzle housing 12. A dust or waste thread collector 30 accommodating a rotor 31 and a scraper plate 32 is provided behind the intake opening 18 and between the pair of rollers 17. The rotor 31 is provided with a great number of bristles 33 on its rear circular portion and a rubber piece 35 between its front and rear circular portions for causing the rotor 31 to rotate in both directions. The rotor 31, together with the bristles 33 and the rubber piece 35, constitute a thread catcher for catching waste thread, cotton dust or the like. The scraper plate 32 is also provided with a great number of bristles 34, which are orientated substantially in the same direction as those (33) of the rotor 31. The scraper plate 32 is biased against the rotor 31 by a spring or the like.

An air passage 36 is defined by the upper nozzle housing 12 and a partition wall 37 formed between the intake opening 18 and the intake joint 15. On the dust collector 30 is provided a covering plate 38, which is pivotable about a pivot shaft 40 to open or close an opening 39 formed in an upper plate of the dust collector 30. Upon operation of the lever 28, the opening 39 of the dust collector 30 is opened or closed by the covering plate 38, since a cam 41 securely connected to the lever 28 engages with a cam plate 42 securely connected to the pivot shaft 40 of the covering plate 38 which is biased by a spring 43 in a direction in which the covering plate 38 is opened. Cam 41 is securely connected to the lever 28 by the brush regulators 23 (note FIG. 9), such that movement of the brush regulators 23 by the lever 28 simultaneously moves the cam 41. Only when the lever 28 is so operated as to slide towards the central portion of the nozzle body 11 is the opening 39 of the dust collector 30 opened so that the dust collector 30 may communicate the air passage 36 with the opening 39.

The pivot shaft 40 of the covering plate 38 has one end 40*a* extending through an opening 45 formed in the dust collector 30 and the other end 40*b* connected to the dust collector 30 by way of the spring 43 so that the pivot shaft 40 may not be readily detached from the dust collector 30 by virtue of a bent end portion 43*a* of the spring 43. The dust collector 30 is provided with a projection 30*a* integrally formed therewith and protruding downwards therefrom towards the rotor 31. The projection 30*a* is encircled by a shock absorber 46. Upon rotation of the rotor 31 in a direction in which the rubber piece 35 moves frontwards, an end of the front circular portion thereof is brought into contact with the shock absorber 46, thereby lightening collision between these two members. The radius of the rear circular portion of the rotor 31 is greater than that of the front circular portion so that the bristles 33 of the rear circular portion may be brought into contact with those (34) of the scraper plate 32, whereas the front circular portion may not.

In operation, the protruding length of bristles 25 of the brushes 22 is regulated according to the state of a surface to be cleaned. For example, when the surface to be cleaned is a carpet, the brushes 22 are in their completely retracted state. When the operator requires only a relatively weak suction force, the brushes 22 are caused to protrude to their maximum length. When the operator requires a strong suction force to clean a hard floor, the brushes 22 are caused to be in a state between their retracted state and the state of maximum protrusion. The protruding length of the brushes 22 is regulated by sliding the brush regulators 23 on either side using the lever 28, resulting in vertical movement of the brushes 22 along cam grooves (not shown). Thus, reciprocal movement of the lever 28 reciprocates the brush regulators 23 to vertically move the brushes 22, at the same time causing the cam 41 connected to the brush regulators 23 to also reciprocate and engage with cam plate 42 to turn pivot shaft 40 for opening and closing movement of covering plate 38. Dust on the hard floor is drawn into the nozzle body 11 through the intake opening 18 and the intake grooves 19 extending outwards therefrom. The dust is then drawn into the cleaner body through the intake joint 15.

When the carpet is cleaned, the lever 28 is set on the central side of the nozzle body 11 to completely retract the brushes 22 inside the nozzle body 11. In this event, the covering plate 38 opens a rear portion of the opening 39 of the dust collector 30 so that the dust collector 30 may communicate with the air passage 36. Accordingly, the suction force from the cleaner body smoothly acts upon fibrous dust such as waste thread or the like caught in the dust collector 30. Thus, the dust is caused to effectively rush out of the dust collector 30 into the air passage 36. Furthermore, since the opening 39 of the dust collector 30 is opened at its rear portion, intake air drawn into the intake opening 18 can form a smooth air flow in the air passage 36, causing a noise produced by collision of the intake air with the covering plate 38, or a noise of the air flow being reduced.

Figure 7:
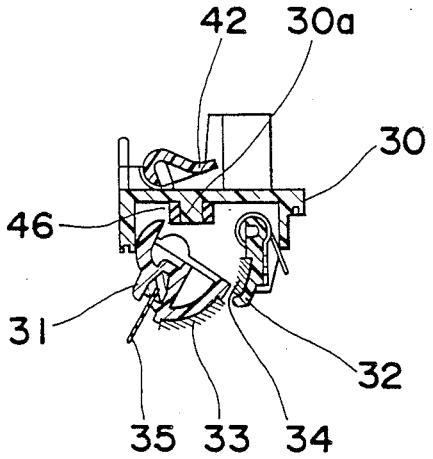
FIG. 7 is a section taken along the line VII—VII of FIG. 4, indicative of a state in which a rotor accommodated in the, dust collector has rotated frontwards.
Figure 8:
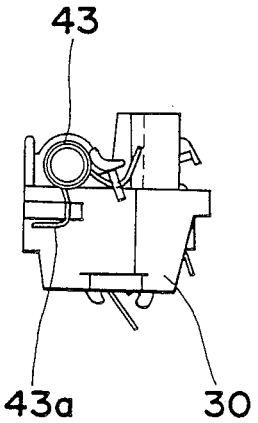
FIG. 8 is a section taken along the line VIII—VIII of FIG. 4.

When the operator pulls back on the nozzle body 11 during use, the rubber piece 35 of the rotor 31 is caught by the carpet and moves frontwards. Consequently, as shown in FIG. 7, the bristles 33 of the rotor 31 are brought into contact with the surface to be cleaned to catch any waste thread. When the operator pushes the nozzle body 11 forward, the rotor 31 rotates rearwards so that the bristles 33 thereof confront those (34) of the scraper plate 32. Thereafter, when the operator pulls back on the nozzle body 11 again, the rotor 31 rotates frontwards so that the bristles 33 thereof confront the surface to be cleaned. At this point the waste thread is raked up by the bristles 34 of the scraper plate 32, and little remains on the bristles 33 of the rotor 31. In this way, the rotor 31 is kept in a clean state at all times, causing the nozzle body 11 to be used to its full ability.

The waste threads raked up by the bristles 34 are rapidly drawn into the air passage 36 by virtue of the suction force of the cleaner body. Accordingly, little of the dust accumulated in the dust collector 30 will remain therein.

In particular, since the dust collector 30 is provided between a pair of rollers 17, the bristles 33 of the rotor 31 are caught by the carpet hardly more than is necessary when the carpet is cleaned. This fact is conducive to improved operability of the cleaner and causes the dust on the carpet to be readily removed. When a hard floor is cleaned, the bristles 33 of the rotor 31 are never brought into contact with the floor, since the nozzle body 11 is securely supported by the rollers 17. As a result, sand or other hard particles are neither caught by the bristles 33 nor damage the floor. The cleaner having such a nozzle body 11, therefore, can be used with superior operability.

Moreover, the shock absorber 46 encircling the projection **30*a* of the dust collector 30 dampens the collision of the front circular portion of the rotor 31 against the projection 30*a*, which collision occurs upon rotation of the rotor 31**. Accordingly, not only is little abnormal noise produced by the collision, but the operator feels little shock in handling the cleaner.

In addition, since the front circular portion of the rotor 31 is smaller in radius than the rear circular portion thereof, the entire rotor 31 can be formed into a compact size, thus greatly contributing to the miniaturization of the nozzle body 11.

In assembling the nozzle body 11, the rotor 31, the scraper plate 32 and the like are initially accommodated in the dust collector 30 with the covering plate 38 being securely held on the opening 39 of the dust collector 30. Several portions which require accurate dimension for proper dust collecting operation of the cleaner are formed into one or more units, resulting in an effectively improved design and rendering the floor nozzle to be readily formed into a desired air-tight construction.

Although the amount of intake air drawn into the intake opening 18 decreases when the covering plate 38 opens the opening 39 of the dust collector 30, a relatively small quantity of air, which hardly exerts any influence upon the dust collecting performance of the cleaner, is enough for flowing dust out of the dust collector 30. The dust collector 30 can raise the performance of the cleaner in collecting waste thread and the like, and is conducive to a reliable and remarkably easy-to-use cleaner which is superior in operability not only on a carpet but also on a hard floor.

Figure 12:
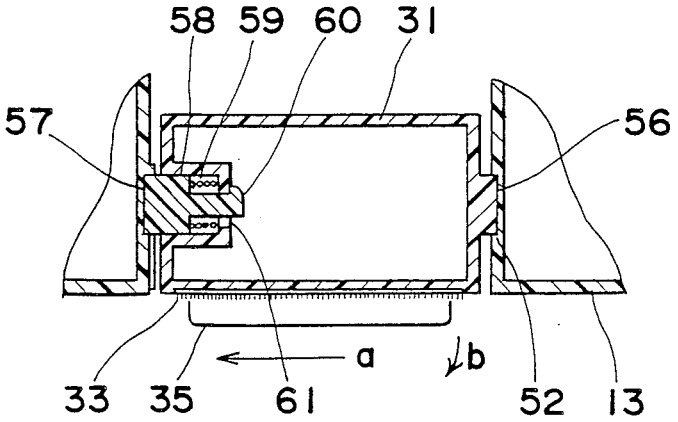
FIG. 12 is a fragmentary sectional view of a portion where the rotor is provided, indicative of a state in which the rotor is detachably mounted in a lower nozzle housing.

FIG. 12 depicts a state in which the rotor 31 is detachably mounted in the lower nozzle housing 13. A pair of concave bearing portions 52 are formed in the lower nozzle housing 13 on respective sides thereof. The rotor 31 is provided with a boss 56 integrally formed therewith on one side thereof and a circularly hollowed wall 58 formed on the other side thereof for receiving a rotary shaft 57. The boss 56 and the rotary shaft 57 inserted into the hollowed wall 58 engage with respective bearing portions 52 for rotation of the rotor 31 there about. The rotary shaft 57 is biased against the corresponding bearing portion 52 by means of a compression spring 59 accommodated in a space defined by the hollowed wall 58 and the rotary shaft 57. A hook 60 is integrally formed with the rotary shaft 57 and extends through a hole formed in the hollowed wall 58 to prevent the rotary shaft 57 from slipping off.

If the rotor 31 having the above described construction is caused to slide in a direction shown by an arrow (a) by holding the rubber piece 35, the boss 56 of the rotor 31 is off of the corresponding bearing portion 52. Then, when the rotor 31 is caused to move in a direction shown by an arrow (b), it can be readily removed from the lower nozzle housing 13.

Accordingly, when the bristles 33 of the rotor 31 are almost worn out, or when cotton dust or the like has undesirably entered a gap between the rotor 31 and the scraper plate 32, the rotor 31 can be readily dismounted from and remounted to the lower nozzle housing 13, without any special tool, thus resulting in simplified nozzle maintenance.

As is clear from the above, the floor nozzle according to the present invention can positively catch waste thread or any other dust to draw it thereinto, irrespective of the surface to be cleaned. In addition, the floor nozzle of the present invention is superior in operability and easy to assemble, and of a construction simplifying its maintenance.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A floor nozzle of a vacuum cleaner, comprising:

an upper nozzle housing having a portion adapted to be hingedly connected to an intake joint of a vacuum cleaner;

a lower nozzle housing connected to said upper nozzle housing, said lower nozzle housing having an intake opening on a lower side thereof;

a first air passage in said upper and lower nozzle housings and extending between said intake opening and said portion of said upper nozzle housing adapted to be connected to an intake joint of a vacuum cleaner;

a dust collector disposed in said upper and lower nozzle housings, said dust collector having a second air passage therein for communication with said first air passage;

a rotor rotatably mounted in said dust collector and communicating with said second air passage, said rotor comprising a cleaning means for cleaning material from a surface to be cleaned upon rotation of said rotor in one direction, said rotor further comprising means for rotating said rotor in said one direction and an opposite direction in response to movement of said floor nozzle in a first direction and a second direction, respectively, across a surface to be cleaned;

scraper means in said dust collector for removing material from said cleaning means when said rotor is rotated in said opposite direction by movement of said floor nozzle in said second direction; and a closure means hingedly connected to said dust collector for opening and closing said second air passage to said first air passage.

2. The floor nozzle as set forth in claim 1, and further comprising a pair of rollers disposed adjacent said portion of said upper nozzle housing, wherein said dust collector is located between said rollers.

3. The floor nozzle as set forth in claim 2, wherein said rollers extend to a point lower than the lowest point of said rotor.

4. The floor nozzle as set forth in claim 1, wherein said cleaning means and said scraper means each comprises a plurality of short bristles.

5. The floor nozzle as set forth in claim 1, wherein said rotor has a circular external surface and said cleaning means comprises a plurality of bristles on said circular external surface.

6. The floor nozzle as set forth in claim 5, wherein said means for rotating comprises an elastic member on said circular external surface.

7. The floor nozzle as set forth in claim 6, wherein said bristles are provided on said external surface of said rotor behind said elastic member.

8. The floor nozzle as set forth in claim 6, wherein said rotor comprises a second circular external surface, the first said circular external surface is located behind said elastic member, said second circular external surface is located in front of said elastic member, and the radius of said first circular external surface is larger than that of said second circular external surface.

9. The floor nozzle as set forth in claim 7, wherein said rotor comprises a second circular external surface, the first said circular external surface is located behind said elastic member, said second circular external surface is located in front of said elastic member, and the radius of said first circular external surface is larger than that of said second circular external surface.

10. The floor nozzle as set forth in claim 5, wherein said bristles of said cleaning means are directed so as to catch and rake up material on the surface to be cleaned when said floor nozzle is moved in said second direction.

11. The floor nozzle as set forth in claim 5, and further comprising an elastic stopper on said dust collector for limiting rotation of said rotor when said floor nozzle is moved in said second direction such that said bristles of said rotor will confront the surface to be cleaned.

12. The floor nozzle as set forth in claim 1, wherein said scraper means is movably mounted in said dust collector and said dust collector has a means for biasing said scraper means toward said rotor.

13. The floor nozzle as set forth in claim 1, wherein said closure means comprises a covering plate disposed at the junction between said first and second air passages, has a hinge connection at a front end thereof, and covers said second air passage in its closed position.

14. The floor nozzle as set forth in claim 1, wherein said rotor is detachably mounted in said dust collector.

15. The floor nozzle as set forth in claim 1, wherein said scraper means is mounted in said dust collector; and said scraper means, said rotor, said closure means and said dust collector having said second air passage therein together comprise a dust collecting unit.

16. A floor nozzle of a vacuum cleaner, comprising:

an upper nozzle housing having a portion adapted to be hingedly connected to an intake joint of a vacuum cleaner;

a lower nozzle housing connected to said upper nozzle housing, said lower nozzle housing having an intake opening on a lower side thereof;

a first air passage in said upper and lower nozzle housings extending between said intake opening and said portion of said upper nozzle housing adapted to be connected to an intake joint of a vacuum cleaner;

a dust collector disposed in said upper and lower nozzle housings, said dust collector having a second air passage therein for communication with said first air passage;

a rotor rotatably mounted in said dust collector and communicating with said second air passage, said rotor comprising a cleaning means for cleaning material from a surface to be cleaned upon rotation of said rotor in one direction, said rotor further comprising means for rotating said rotor in said one direction and an opposite direction in response to movement of said floor nozzle in a first direction and a second direction, respectively, across a surface to be cleaned;

scraper means in said dust collector for removing material from said cleaning means when said rotor is rotated in said opposite direction by movement of said floor nozzle in said second direction;

a closure means hingedly connected to said dust collector for opening and closing said second air passage to said first air passage;

a pair of brushes disposed adjacent and parallel to said intake opening, said pair of brushes mounted so as to be protrudable and retractable from said lower nozzle housing; and driving means for driving said pair of brushes to protrude and retract from said lower nozzle housing and simultaneously operate said closure means.

17. The floor nozzle as set forth in claim 16, wherein said driving means operates said closure means to open said second air passage when said brushes are driven to a retracted position.

* * * * *